United States Patent [19]

Dorsey et al.

[11] 4,260,282

[45] Apr. 7, 1981

[54] PORTABLE BOAT RAMP

[76] Inventors: Charles L. Dorsey, 600 W. Formosa St.; Donald L. Dorsey, 431 W. Granite St., both of Siloam Springs, Ark. 72761; Sam M. Richardson, III, P.O. Box 1582 Industrial Rd., Eldorado, Ark. 71730

[21] Appl. No.: 3,918

[22] Filed: Jan. 16, 1979

[51] Int. Cl.[3] ..... B63C 3/00

[52] U.S. Cl. ..... 405/1; 9/1.2

[58] Field of Search ..... 114/44, 50, 55; 9/1.1, 9/1.2, 6 R, 6 P, 400; 405/1, 5, 7, 4; 280/414 R; 108/51.1, 51.3, 53.1, 53.3, 55.1, 55.3, 55.5, 901, 902; 248/146, 148, 152

[56] References Cited

U.S. PATENT DOCUMENTS

| | | | |
|---|---|---|---|
| 3,055,022 | 9/1962 | Vallquist | 405/1 X |
| 3,285,515 | 11/1966 | Dickinson | 405/1 X |
| 3,339,217 | 9/1967 | Gudmundson | 9/1.2 |
| 3,353,363 | 11/1967 | Edson | 405/1 |
| 3,360,809 | 1/1968 | Gudmundson | 9/1.2 |
| 3,365,733 | 1/1968 | Gudmundson | 9/1.2 |
| 3,884,440 | 5/1975 | Rowley et al. | 248/346 |
| 3,990,258 | 11/1976 | Ford | 405/1 |
| 4,126,963 | 11/1978 | Dunbar | 248/146 X |

FOREIGN PATENT DOCUMENTS

| | | | |
|---|---|---|---|
| 1488394 | 6/1966 | France | 9/1.2 |

*Primary Examiner*—Charles E. Frankfort
*Attorney, Agent, or Firm*—Diller, Ramik & Wight

[57] ABSTRACT

This disclosure relates to a portable boat ramp adapted for use by skiers, fishermen, campers and the like to protect the bottom and bow of a boat when beaching the like and includes protecting means in the form of a bottom wall and a pair of hollow upstanding walls disposed in generally converging relationship to each other upon and between which is adapted to be disposed the bow of a boat whereby the latter is protected when the boat ramp is resting upon a supporting surface such as a shore, the bed of a body of water, or the like.

12 Claims, 4 Drawing Figures

PORTABLE BOAT RAMP

The present invention is directed to a novel portable boat ramp which is particularly adapted to be used by skiers, fishermen, campers, canoers and the like to protect the bottom and bow of a boat when the latter is being beached.

The portable boat ramp is preferably constructed from molded polymeric plastic material and includes a bottom wall and a pair of upstanding walls disposed in generally converging relationship to each other having opposite terminal end portions at maximum spaced relationship to each other defining an entrance opening through which a boat bow may be readily entered into and between the upstanding walls to rest thereagainst and, thus, be protected when the ramp is seated upon a shore, a bed of a body of water, or the like.

In further accordance with this invention and as another object thereof, the portable boat ramp preferably is constructed such that the upstanding walls are hollow and each is defined by inner and outer walls converging from the bottom wall toward a top closed wall of each.

Yet another object of this invention is to provide a novel portable boat ramp of the type heretofore set forth wherein the bottom wall preferably includes a first bottom wall portion adjacent the entrance opening of the ramp and a second bottom wall portion remote therefrom with the second bottom wall portion being at a higher elevation than the first bottom wall portion.

Yet another object of this invention is to provide a novel portable boat ramp of the type heretofore set forth wherein the upstanding walls merge with each other at end portions thereof in minimum spaced relationship to each other, and a narrowest bottom wall portion of the bottom wall is disposed at the merger of the upstanding walls to receive thereupon the keel of a boat.

Still another object of this invention is to provide a novel portable boat ramp of the type heretofore set forth wherein the inner and outer upstanding walls are stepped between the top wall and the bottom wall to reinforce the ramp.

With the above and other objects in view that will hereinafter appear, the nature of the invention will be more clearly understood by reference to the following detailed description, the appended claims and the several views illustrated in the accompanying drawings.

Figure 1:
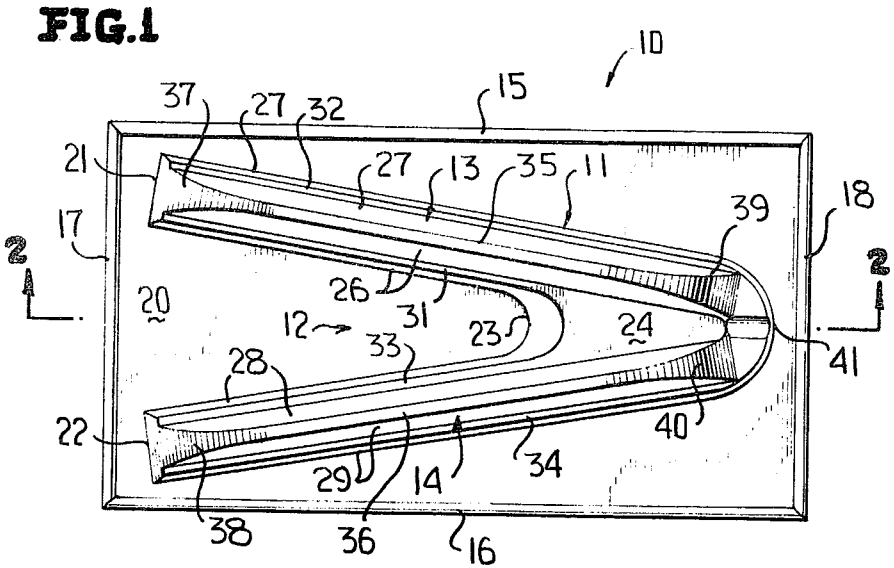
FIG. 1 is a top plan view of a novel portable boat ramp constructed in accordance with this invention, and illustrates a bottom wall and a pair of upstanding walls which converge from left-to-right as is viewed in this figure.

A novel portable boat ramp constructed in accordance with this invention is generally designated by the reference numeral 10, and includes means generally designated by the reference numeral 11 for protecting the bow B (FIG. 2), bottom B1, and keel K of a boat or similar watercraft W. The portable boat ramp 10 is constructed from a single piece of molded polymeric or copolymeric plastic material, such as high density polyethylene.

The protecting means 11 includes a bottom wall 12 and a pair of upstanding walls 13, 14 which are disposed in generally converging relationship from left-to-right, as viewed in FIG. 1. The overall configuration of the bottom wall 12 is generally rectangular and is set-off by downwardly opening longitudinal reinforcing beads 15, 16 and downwardly opening transverse reinforcing beads 17, 18. The portion (unnumbered) of the bottom wall 12 outboard of the upstanding walls 13, 14 generally provides no protecting function but imparts stability to the portable boat ramp 10 when it is placed upon a supporting surface S (FIG. 2), such as a shore, the bed of a body of water, or the like. However, the generally triangular portion (unnumbered) of the bottom wall 12 between the upstanding legs 13, 14, as is best seen in FIG. 1, protects the bottom B1 and/or the keel K of the boat W in the manner most readily apparent from FIG. 2, as will be described more fully hereinafter. The bottom wall 12 includes a bottom wall portion 20 of a generally triangular configuration (FIG. 1) disposed between the upstanding walls 13, 14 between terminal end portions 21, 22 of the respective upstanding walls 13, 14 and a curved radius wall 23 (FIG. 1). The bottom wall 12 further includes another bottom wall portion 24 of the triangular configuration (FIG. 1) which is at a higher elevation than the bottom wall portion 20 of the bottom wall 12, as is most readily apparent from FIG. 2 of the drawing. An inclined curved wall portion 25 merges with the upstanding walls 13, 14, and joins the radius portion 23 to the uppermost bottom wall portion 24.

The upstanding walls 13, 14 are hollow (FIGS. 3 and 4) and each is defined by respective inner and outer walls 26, 27 and 28, 29 having respective stepped wall portions or steps 31 through 34 (FIGS. 3 and 4) disposed between the bottom wall 12 and respective top walls 35, 36. The walls 26, 27 converge generally upwardly toward the top wall 35 as do the walls 28, 29 which converge upwardly toward the top wall 36 with the steps 31 through 32 and 33 through 34, respectively, being provided for reinforcement purposes. The portions (unnumbered) of the walls 26, 28 below the respective steps 31, 34 merge with the wall portion 35 whereas the steps 31, 33 blend or merge with the uppermost bottom wall portion 24 (FIGS. 1, 2 and 3).

Figure 3:
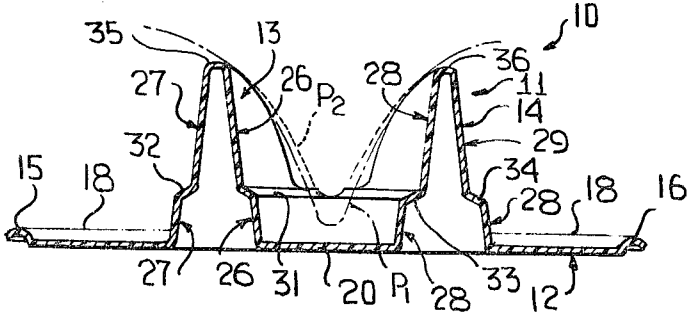
FIG. 3 is a sectional view taken generally along line 3—3 of FIG. 2 and illustrates the hollow construction of the upstanding walls and in phantom outline two differently contoured boat bows and the manner in which the same are received between the upstanding walls.
Figure 2:
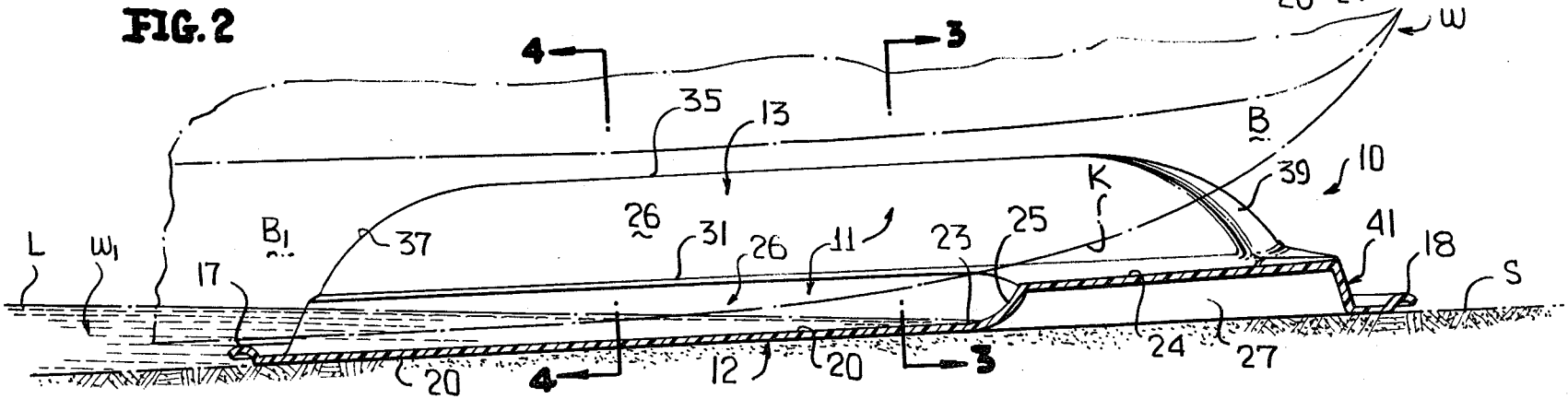
FIG. 2 is an enlarged sectional view taken generally along line 2—2 of FIG. 1, and illustrates the portable boat ramp resting upon the shore or bed of a body of water, and illustrates in phantom outline the bow of a boat received thereon and protected thereby.

The top walls 35, 36 have upwardly, convexly curved wall portions 37, 38, respectively, which progressively widen in a downward direction toward the respective terminal edges 21, 22 of the respective upstanding walls 13, 14 as well as similar upwardly, convexly curved wall portions 39, 40 at end portions (unnumbered) of the upstanding walls 11, 14 which are most closely adjacent to and merge with each other at a generally rounded nose or end wall portion 41 which is a rounded continuation of the outer walls 27, 29, as is most readily apparent from FIGS. 1, 2 and 3 of the drawing.

Figure 4:
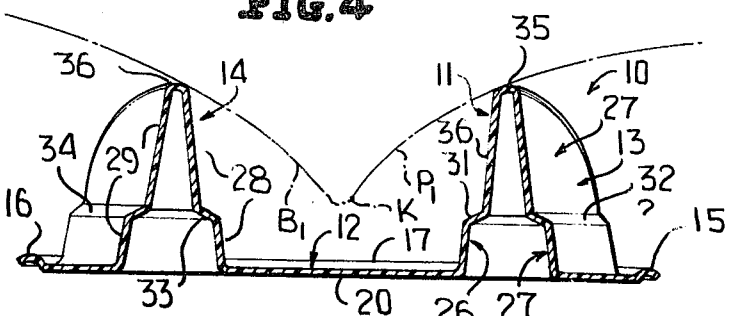
FIG. 4 is a cross sectional view taken generally along line 4—4 of FIG. 2, and illustrates the manner in which the bottom and/or bow of the boat is further protected by the portable boat ramp.

In operation, the portable boat ramp 10 is positioned upon the supporting surface S preferably at least partially submerged beneath the uppermost level L of a body of water W1. The exact positioning of the portable ramp 10 will depend upon numerous factors, but the only principal that need be observed is that the portable boat ramp 10 be positioned upon the surface S such that no portion of the boat W will contact the surface S and instead will contact and, thus, be protected by the ramp 10. When thus positioned, the bow B of the boat W is introduced between the upstanding walls 13, 14 through an entrance area or opening (unnumbered) generally defined between the terminal ends 21, 22 of the upstanding walls 13, 14. As the bow B of the boat W is progressively introduced into the area between the upstanding walls 13, 14, it may or may not contact the bottom wall portion 20 or the tapered wall portion 25 or the triangular uppermost bottom wall portion 24. However, eventually the bow B and its bottom B1 will contact the inner walls 26, 28 and/or portions of the top walls 35, 36, as is indicated by a boat having a profile P1 (FIGS. 3 and 4). The profile P1 of the boat W in question is such that the keel K does not contact any portion of the bottom wall 12 (20 or 24) and merely rests against portions of the inner upstanding walls 26, 28 and the top walls 35, 36 (FIGS. 3 and 4). Should, however, the profile of the bow B of the boat W be as is indicated at P2, the keel K could well rest upon and be protected by the uppermost triangular bottom wall portion 24, as is illustrated in FIG. 3. A relatively blunt nosed watercraft (not shown) may simply rest with its keel K upon the bottom wall portion 20 and against the inner upstanding walls 26, 28 without resting upon the uppermost bottom wall portion 24. However, irrespective of the particular configuration of a bow B of a particularly profiled boat W, the walls 26, 28, 35, 36, 20, 24 and/or 25 singularly or collectively will protect the bottom B1 and the bow B including the keel K of most any particular type of boat W within, of course, reasonable dimensional perimeters. In this manner, sand, rocks, gravel and the like normally associated with a lake or river bottom and/or shore or bed can not adversely effect the bow B, bottom B1 and/or keel K of the boat W.

Although only a preferred embodiment of the invention has been specifically illustrated and described herein, it is to be understood that minor variations may be made in the apparatus without departing from the spirit and scope of the invention, as defined in the appended claims.

We claim:

1. A portable boat ramp comprising means for protecting the bow and bottom of a boat, said protecting means including a lowermost generally horizontally disposed bottom wall and a pair of upstanding walls disposed in generally converging relationship to each other upon and between which is adapted to be disposed the bow of a boat whereby the latter is protected when said protecting means is resting upon a supporting surface such as a shore, the bed of a body of water, or the like, said upstanding walls each being hollow and each including inner and outer upstanding walls, said inner and outer upstanding walls having uppermost edges merging with a top wall, a lowermost edge of each of said outer upstanding walls lying generally in the plane of said bottom wall, said inner and outer upstanding walls being in generally converging relationship in a direction toward said top wall, a peripheral bottom wall merging with each of said outer upstanding wall lowermost edges thereby effecting a stable base for a boat adapted to rest upon the portable boat ramp when the latter is in use, and said lowermost bottom wall and said peripheral bottom wall both being in the same plane.

2. The portable boat ramp as defined in claim 1 wherein said upstanding walls have opposite terminal end portions in maximum spaced relationship to each other defining an entrance opening through which a boat bow may readily enter into and between said upstanding walls.

3. The portable boat ramp as defined in claim 1 wherein said upstanding walls merge at end portions thereof in minimum spaced relationship to each other.

4. The portable boat ramp as defined in claim 1 wherein said upstanding walls have opposite terminal end portions in maximum spaced relationship to each other defining an entrance opening through which a boat bow may readily enter into and between said upstanding walls, and said upstanding walls merge at other end portions thereof in minimum spaced relationship to each other.

5. The portable boat ramp as defined in claim 1 wherein said ramp is formed of a single piece of molded polymeric plastic material.

6. The portable boat ramp as defined in claim 1 wherein each of said inner and outer upstanding walls are stepped between said top and bottom walls.

7. The portable boat ramp as defined in claim 1 wherein said upstanding walls merge at end portions thereof in minimum spaced relationship to each other.

8. The portable boat ramp as defined in claim 2 wherein said upstanding walls merge at end portions thereof in minimum spaced relationship to each other.

9. The portable boat ramp as defined in claim 10 wherein said upstanding walls merge at end portions thereof in minimum spaced relationship to each other.

10. The portable boat ramp as defined in claim 1 wherein said upstanding walls have opposite terminal end portions in maximum spaced relationship to each other defining an entrance opening through which a boat bow may readily enter into and between said upstanding walls, said bottom wall having a first bottom wall portion adjacent said entrance opening and a second bottom wall portion remote from said first bottom wall portion, and said second bottom wall portion is at a higher elevation than said first bottom wall portion.

11. The portable boat ramp as defined in claim 10 wherein said upstanding walls merge at a nose remote from said opposite terminal end portions, and said top walls in the area of said nose converge toward each other in a direction downwardly toward said second bottom wall portion and terminate contiguous thereto.

12. The portable boat ramp as defined in claim 11 wherein each of said inner and outer upstanding walls are stepped between said top and bottom walls.

* * * * *